United States Patent [19]

McDavid, Jr. et al.

[11] 3,938,698

[45] Feb. 17, 1976

[54] APPARATUS FOR DISPENSING ADHESIVE LABELS

[75] Inventors: James E. McDavid, Jr., Chagrin Falls; Stanley E. Truesdell, Mentor; Elmer Thomas Chipps, Mentor-on-the-Lake, all of Ohio

[73] Assignee: Avery Products Corporation, San Marino, Calif.

[22] Filed: Nov. 27, 1974

[21] Appl. No.: 527,857

[52] U.S. Cl. ..... 221/73; 156/541; 156/566; 156/568

[51] Int. Cl.[2] ..... B65H 5/28

[58] Field of Search ..... 221/70–73; 156/540, 541, 542, 361, 566–568, 571, DIG. 33; 53/137

[56] References Cited

UNITED STATES PATENTS 2,621,434 12/1952 Jackson et al. ..... 156/542

*Primary Examiner*—Robert B. Reeves
*Assistant Examiner*—Joseph J. Rolla
*Attorney, Agent, or Firm*—Christie, Parker & Hale

[57] ABSTRACT

A machine for transferring adhesive labels from both sides of a single carrier strip to two separate streams of product items on a continuous basis. A pair of spaced continuously rotating vacuum wheels come in contact with opposite sides of the carrier strip, the carrier strip passing around a loop-forming roller adjacent each vacuum wheel to bring the label in contact with the vacuum wheel. Each vacuum wheel has holes around the periphery thereof, a vacuum being applied through the openings in a stationary sector of the vacuum wheel. As each label comes in contact with the associated vacuum wheel, it is pulled off by the vacuum and transported through the sector angle to a release point, where it is transferred to the surface of a product item.

9 Claims, 7 Drawing Figures

APPARATUS FOR DISPENSING ADHESIVE LABELS

FIELD OF THE INVENTION

This invention relates to label applicators, and more particularly, is concerned with an applicator for transferring labels from both sides of a single carrier strip to streams of product items on a continuous basis.

BACKGROUND OF THE INVENTION

It is well known to apply labels to a stream of product items or the like on a continuous basis. Normally pressure-sensitive adhesive labels are stored on a backing strip or carrier from which the labels are peeled and applied to the surface of a product item or the like. Generally the label is removed from the carrier strip by pulling the strip around a sharp edge. The inherent stiffness of the label material is sufficient to overcome the adhesion of the label to the carrier strip, so that the label separates from the carrier strip as the strip bends sharply around the peeling edge. As the label is peeled in this manner off the carrier strip, it is pressed against the adjacent surface of a product item, the items being moved in a continuous stream pass the point at which the labels are applied.

SUMMARY OF THE INVENTION

The present invention is directed to an applicator for transferring labels from both sides of a single carrier strip and applying them to two separate streams of product items. Known machines for automatically transferring labels from a carrier strip to a stream of product items on a continuous basis, such as described above, are not suitable for transfer of labels from both sides of the carrier strip on a single pass of the carrier strip through the machine. With labels on both sides of the carrier strip, the strip cannot be effectively drawn around a sharp edge for the purpose of peeling the labels on the carrier. The frictional and bending forces encountered in such an arrangement, particularly where the carrier strip is moving at relative high velocity, result in damage to the labels and/or breaking or tearing of the carrier strip. Thus, such known types of applicators are not suitable for transferring and applying labels from both sides of the carrier strip of a common carrier strip.

Furthermore, in known applications of this type, the linear surface speed of the label, carrier strip, and product item to which the label is being affixed must be kept the same since a portion of the label adheres to the item while another portion is still affixed to the carrier strip or to an intermediate transfer mechanism. This presents problems of control in adjusting to labels of different length and/or product items of different sizes.

SUMMARY OF THE INVENTION

The present invention provides a method and apparatus for transferring labels on a continuous basis from both sides of a moving carrier strip and affixing the labels to product items in two separate streams of items. The apparatus is capable of operating with very high carrier feed rates. The machine can apply labels of different lengths to the two streams of products and the products in the two streams need not be identically spaced.

In brief, the present invention provides an arrangement in which a carrier strip having adhesive labels spaced along both sides of the strip is driven at high speed between a supply reel and a take-up reel. The carrier strip passes in a partial loop over a first roller in contact with one side of the carrier strip and then in a partial loop over a second roller in contact with the opposite side of the strip. First and second cylindrical drums are positioned adjacent the respective loops, the outer cylindrical surface moving tangentially to the carrier strip as it passes over the respective rollers. The drums have a plurality of openings to the interior around the periphery of the cylindrical surfaces, a vacuum being applied through the openings in a stationary sector of the respective drums. The product items in two separate streams are in turn moved into tangential contact with the respective drums adjacent the ends of the vacuum sectors. The labels are transferred by the drums, which grip the labels by means of the differential pressure produced by the vacuum, from the carrier strip to the product item.

DESCRIPTION OF THE DRAWINGS

For a more complete understanding of the invention reference should be made to the accompanying drawings, wherein.

DETAILED DESCRIPTION OF THE DRAWINGS

Figure 1:
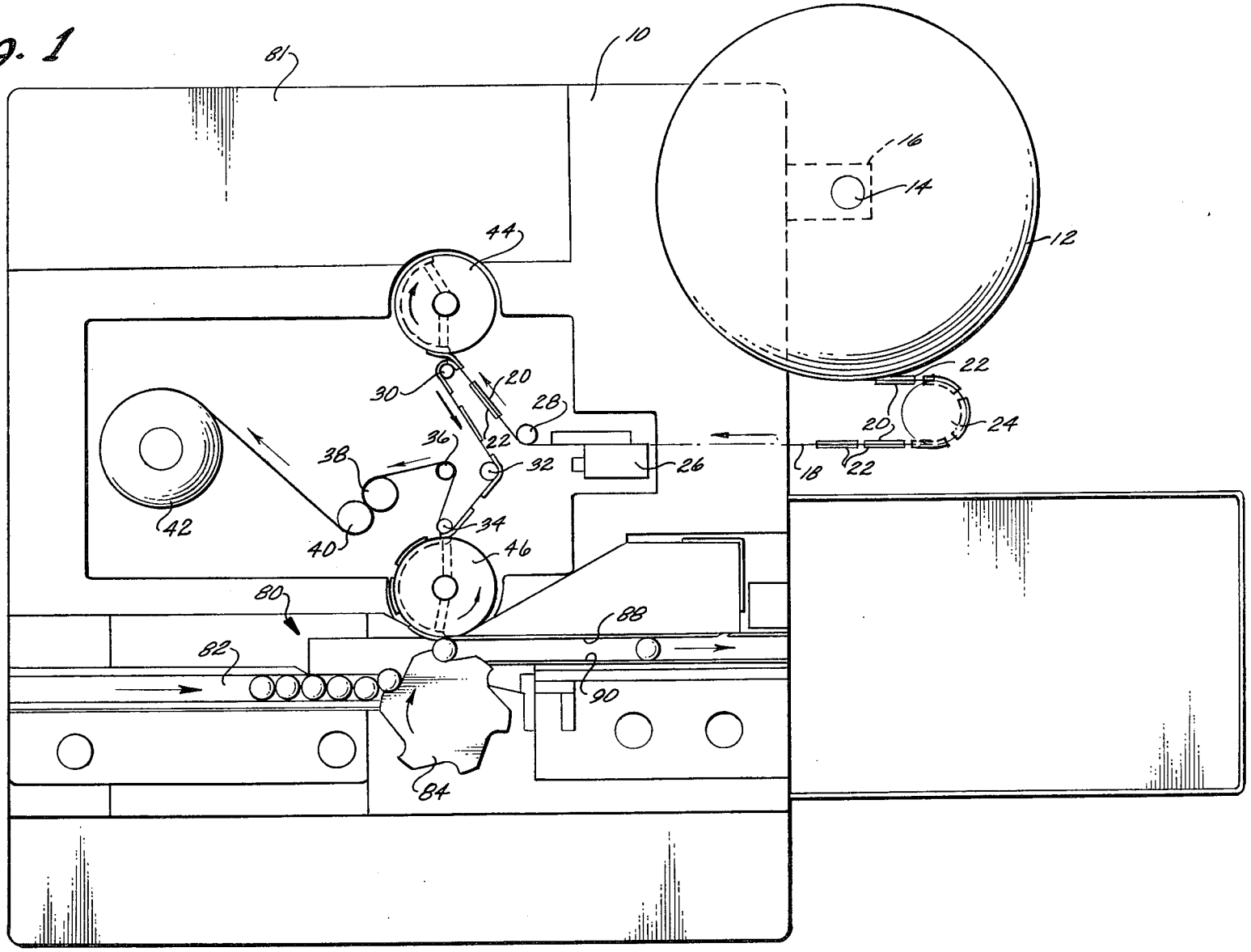
FIG. 1 is a schematic plan view of the dual label applicator apparatus of the present invention.

Before describing the applicator apparatus in detail, reference should be made to the schematic representation in FIG. 1 which shows the basic functional features of the machine. A supply reel 12 is rotatably mounted on a spindle 14 projecting from a bracket 16 extending from the frame 10. The supply reel 12 has a carrier strip 18 initially wound thereon. The carrier strip 18 has a series of labels 20 affixed to one side and a series of labels 22 affixed to the other side of the carrier strip. (The labels are exaggerated in thickness in the drawing.) The labels 20 and 22 are coated with a pressure-sensitive adhesive on one side which holds the labels onto the surfaces of the carrier strip 18. The carrier strip typically is made of paper or other suitable thin, strong, flexible material which is coated with a lacquer to which the pressure-sensitive adhesive only mildly adheres. The labels adhere to the carrier strip within the normal range of release values provided in standard carrier-type adhesive label dispensers. In other words, the present apparatus does not require any special or abnormal release values for the pressure-sensitive adhesive labels.

The carrier with its dual labels 20 and 22 affixed to both sides passes around a dancer roll 24 which provides some slack to accommodate transient variations in tension of the carrier strip. The carrier strip then passes through a web-tension assembly 26 which applies a uniform drag on the strip to maintain substantially constant tension on the carrier strip as it progresses through the label applicator apparatus.

After passing through the web-tension assembly 26, the dual label carrier strip passes around a guide roller 28 and then in a reverse loop around a first label-transfer roller 30.

From the transfer roller 30, the dual label carrier strip 18 passes around a second guide roller 32 and in a reverse loop around a second label-transfer roller 34. It will be noted that the label transfer rollers 30 and 34 engage opposite surfaces of the dual label carrier strip.

The carrier strip 18, after passing around the transfer roller 34, extends around a guide roller 36 and then passes through a drive roll assembly. The drive roll assembly includes a capstan or drive roller 38 and a pinch roller 40 which clamps the carrier strip against the surface of the drive roller 38. The carrier strip is then wound on a take-up reel 42.

Figure 2:
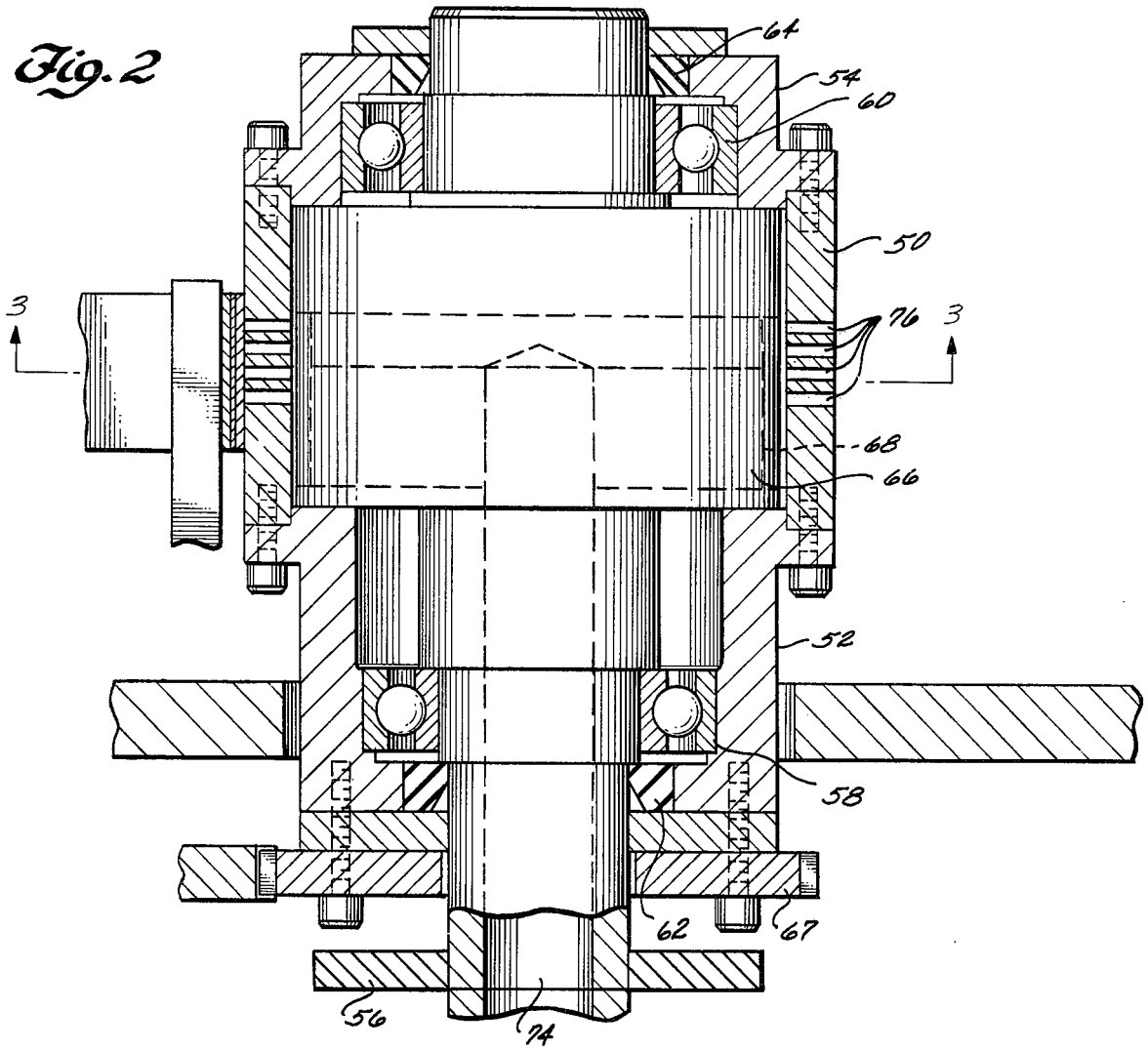
FIG. 2 is a cross-sectional view of a vacuum drum used in connection with the present invention.

The transfer of the labels 20 from one side of the carrier strip 18 takes place at the transfer roller 30, while the transfer of the labels 22 on the opposite side of the carrier strip takes place at the transfer roller 34. The transfer operation is accomplished by a pair of vacuum drums 44 and 46 which are rotatably mounted on the frame 10. The drum 44 rotates in tangential relationship to the transfer roller 30, while the drum 46 rotates in tangential relationship to the transfer roller 34. The transfer operation is best understood by reference to FIGS. 2 and 3 which show the vacuum drum assembly in detail.

The drum assembly includes a rotating hollow cylindrical sleeve 50 having an inner hub 52 secured at one end of the sleeve and an outer hub 54 secured to the other end of the sleeve. The hubs are journaled on and supported by a stationary inner shaft 56 by means of suitable ball bearings 58 and 60. The shaft 56 is anchored at one end to the frame, as hereinafter described. Rotary seals 62 and 64 prevent air leakage along the shaft between the interior of the sleeve 50 and the exterior of the assembly. The hub 52 is rotated by means of a gear 67 attached to the end of the hub.

The shaft 56 has an enlarged cylindrical section 66 which is slightly smaller in outer diameter than the interior of the sleeve 50 and extends axially a distance slightly less than the distance between the hubs 52 and 54. The outer periphery of the central section 66 of the shaft has a recess 68 extending through a sector of slightly less than 180°. This recess forms a plenum chamber which is in communication with a suitable vacuum source through a pair of radial passages 70 and 72 within the shaft section 66, the radial passages intersecting an axial passage 74 extending along the axis of the shaft 56. As hereinafter described, the passage 74 communicates with a vacuum source, so that the plenum chamber formed by recess 68 is maintained at sub-atmospheric pressures.

The sleeve 50 is provided with a plurality of holes or openings 76 arranged in a band around the center of the sleeve. The recessed sector 68 forms an open space adjacent the inner ends of the openings 76. Thus holes 76, as they move by rotation of the sleeve 50 through the sector subtended by the recess 68, are subjected to an inrush of air due to the partial vacuum within the recess 68.

Figure 3:
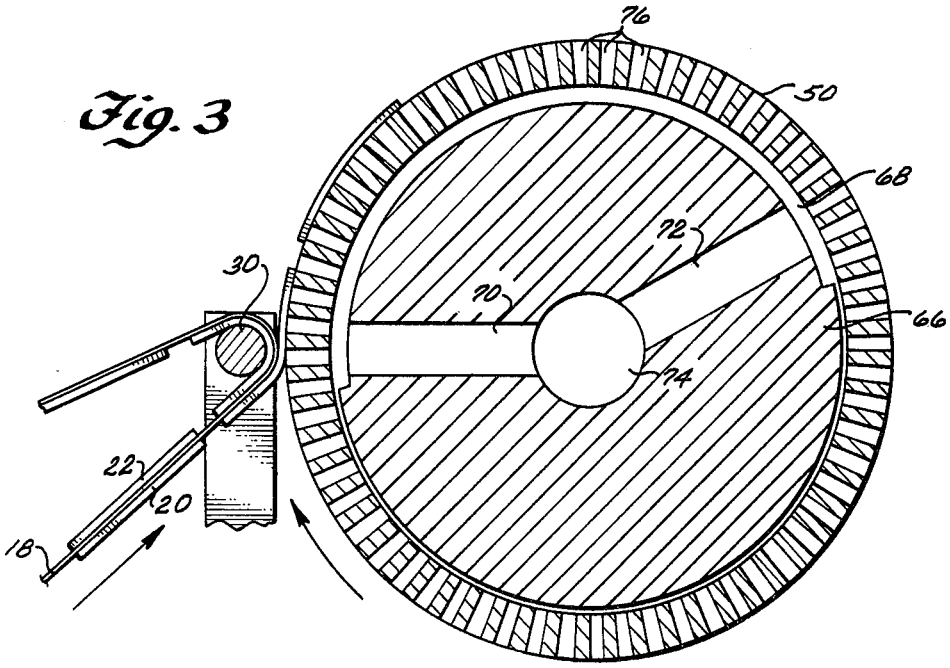
FIG. 3 is a sectional view taken substantially on line 3—3 of FIG. 2.
Figure 4:
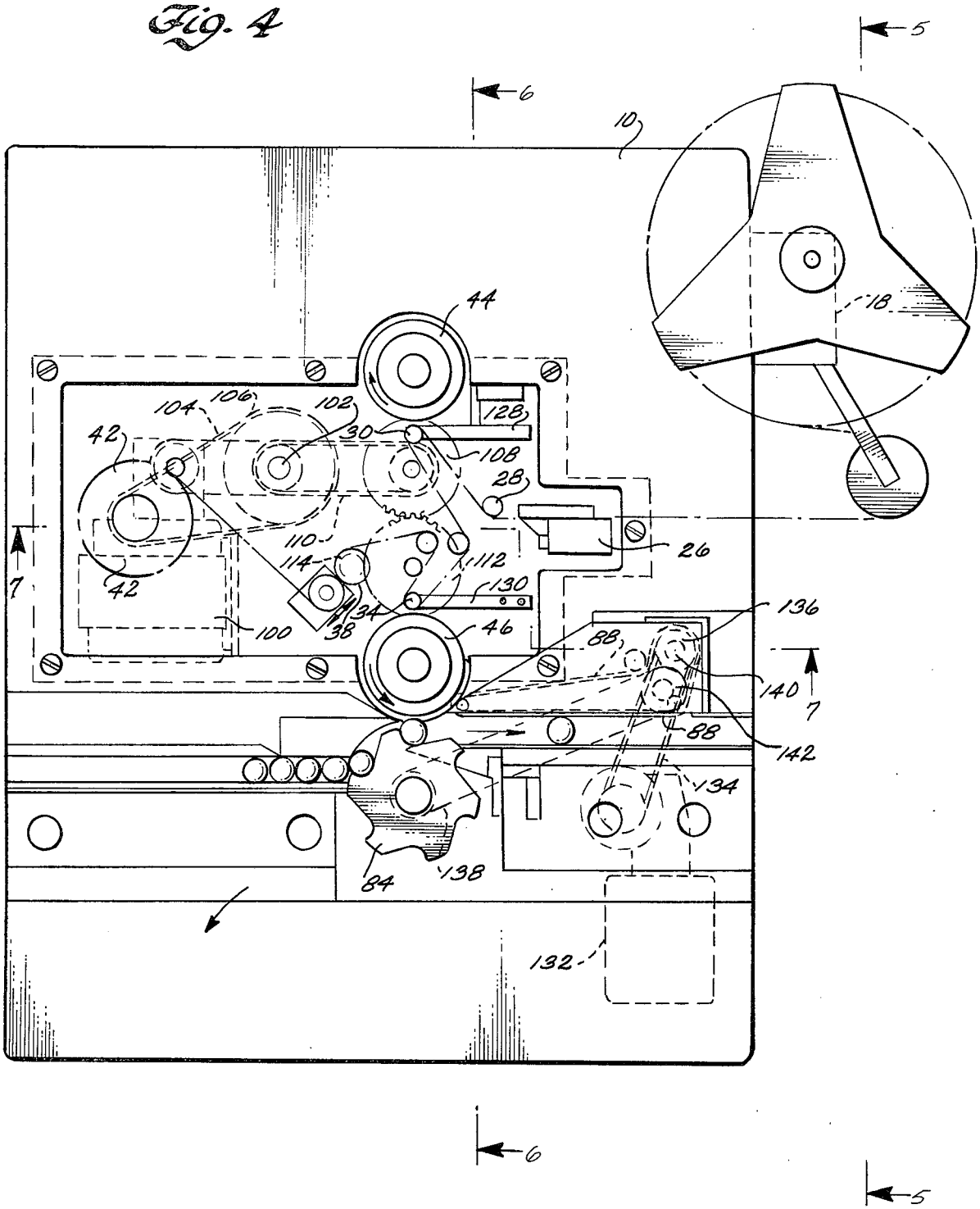
FIG. 4 is a plan view of a preferred embodiment of the invention.
Figure 5:
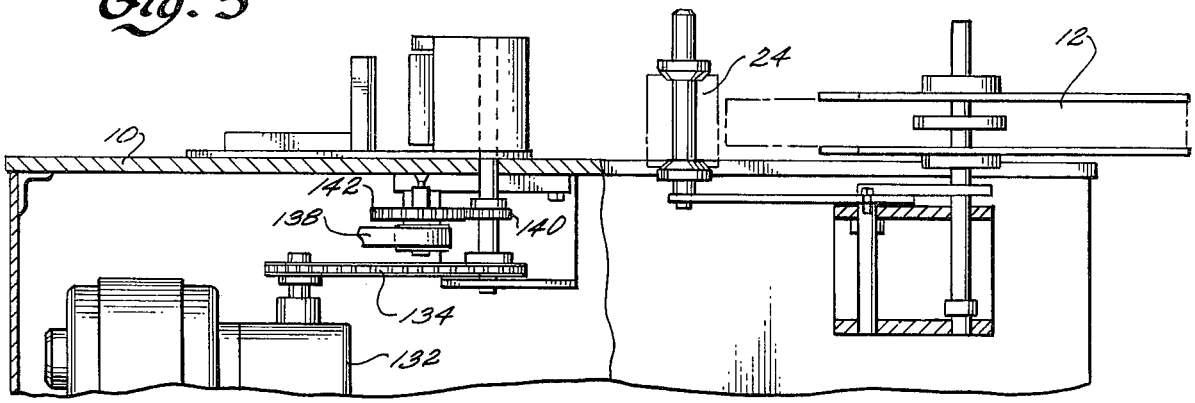
FIG. 5 is an end view of the labeler.
Figure 7:
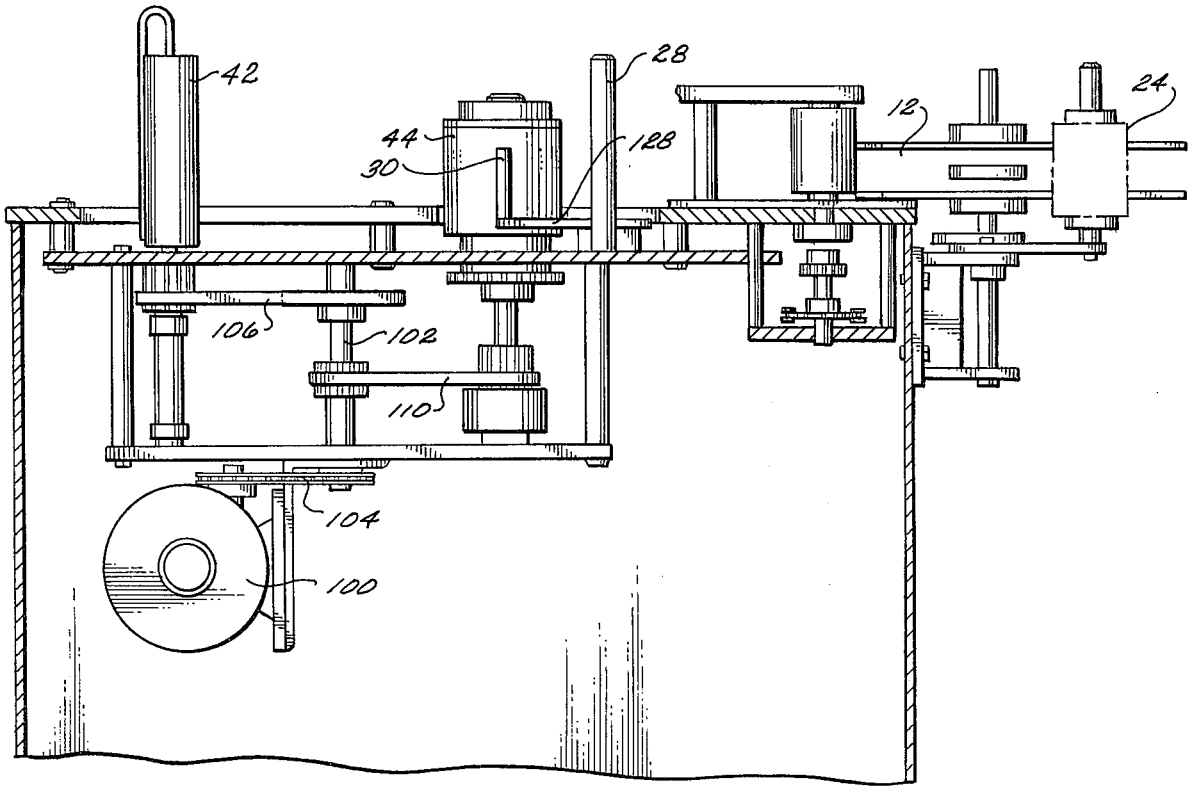
FIG. 7 is a sectional view taken substantially on the line 7—7 of FIG. 4.

As shown in FIG. 3, the carrier strip 18, in passing around the transfer roller 30, moves the labels 20 into contact with the outer periphery of the sleeve 50.

The transfer roller 30 is positioned radially opposite one end of the recess 68 so that the holes 76 in the sleeve 50, as the sleeve rotates in a clockwise direction as viewed in FIG. 3, expose the outer surface of the labels 20 to a partial vacuum at the point where the labels bend around the transfer roller 30. The radius of the transfer roller 30 is sufficiently large that the carrier strip with its dual labels 20 and 22 can easily pass in a loop around the transfer roller 30 without causing the labels to release their grip on the surface of the carrier strip.

Although the turn experienced by the strip in passing around the roller 30 tends to cause the relatively stiff labels 20 on the outside of the carrier strip loop to spring away from the surface of the carrier strip, they do so only under the additional urging of the force of the air being drawn in toward the openings 76 by the reduced pressure within the recess 68. As a result, the labels 20 are separated from the carrier strip 18 and move on to the surface of the rotating sleeve 50 as the carrier strip passes around the transfer roller 30.

The labels 20 are held against the outer periphery of the sleeve 50 by the vacuum in the recess 68 until the label passes the other end of the sector of the recess 68. Since the adhesive surface of the label 20 is exposed while the label is held against the outside of the sleeve 50, by moving the surface of the product item along a path tangential to the outer surface of the sleeve 50, the adhesive surface of the label can be brought into contact with the product item. By arranging the point of contact near the end of the recess 68, the label becomes affixed to the product surface at the same time that the label is released from the surface of the sleeve 50.

Referring again to FIG. 1, there are shown a pair of feed mechanisms, indicated generally at 80 and 81, for moving a series of product items through the label applicator. The product items are shown, by way of example only, as cylindrical containers, such as food or beverage cans, or the like. The product items in the feed mechanism 80 move along a conveyor 82 toward a rotating conveyor member 84 having a series of spaced teeth 86 which engage the product items and move them one at a time into engagement with the periphery of the sleeve portion of the rotating drum assembly 46. As the labels 22 are transferred from the carrier strip to the surface of the vacuum drum 46, in the manner described above, they are transferred by the counterclockwise rotation of the drum 46 to a position where they come in contact with a product item. The product item is moved forward by rotation of the conveyor member 84 to a point where the item comes in contact with a moving belt 88. The cylindrical containor of the product item is caused to roll along a stationary surface 90 by the movement of the belt 88. The rolling action of the container between the surface of the belt 88 and the conveyor surface 90 causes the label to be wrapped around the periphery of the cylindrical container as it moves towards the discharge end of the conveyor. A similar conveyor arrangement 81 is provided for moving product items past the upper vacuum drum 44 for receiving the labels 20 from the carrier strip.

Thus, it will be seen that the above-described apparatus provides for the transfer of labels from both sides of the carrier strip to separate stream of product items. It should be noted that different product items may be accommodated in each of the two streams and different size, shape, and type of labels may be dispensed by the respective vacuum drums. The continuous feed arrangement permits the label dispensing mechanism to operate over a wide range of speeds, with linear speeds of the carrier strip of 2500 inches per minute and higher being readily obtainable.

Moreover, the surface speed of the product item containers need not be identical with the surface speed of the vacuum drums. Once the label comes in contact with the product item, it will move at the speed of the product item but can slide on the relatively smooth surface of the vacuum drum during the transfer interval. It is only necessary that the number of product items being labeled and the number of labels transferred by the associated vacuum drum be maintained on a one-to-one basis. This permits small labels to be affixed to large product items, for example, by moving the product items along the conveyor at a much higher speed than the speed at which the labels are moved by the rotation of the vacuum drum.

The preferred embodiment of the invention is shown in FIG. 4–7. A gear head drive motor 100 drives a pulley shaft 102 through a belt 104. The take-up reel 42 is in turn driven from the shaft 102 through a belt drive 106. The drive of the vacuum drums 44 and 46 is accomplished through a gear train, including a gear 108 rotated from the shaft 102 by a belt drive 110. The gear 108 engages the gear 67 on the drum assembly 44. The drum 46 is similarly driven from the gear 108 through a reversing gear 112. The drums 44 and 46 rotate in opposite directions. The reversing gear 112 engages a gear 114 associated with the drive roller 38.

Figure 6:
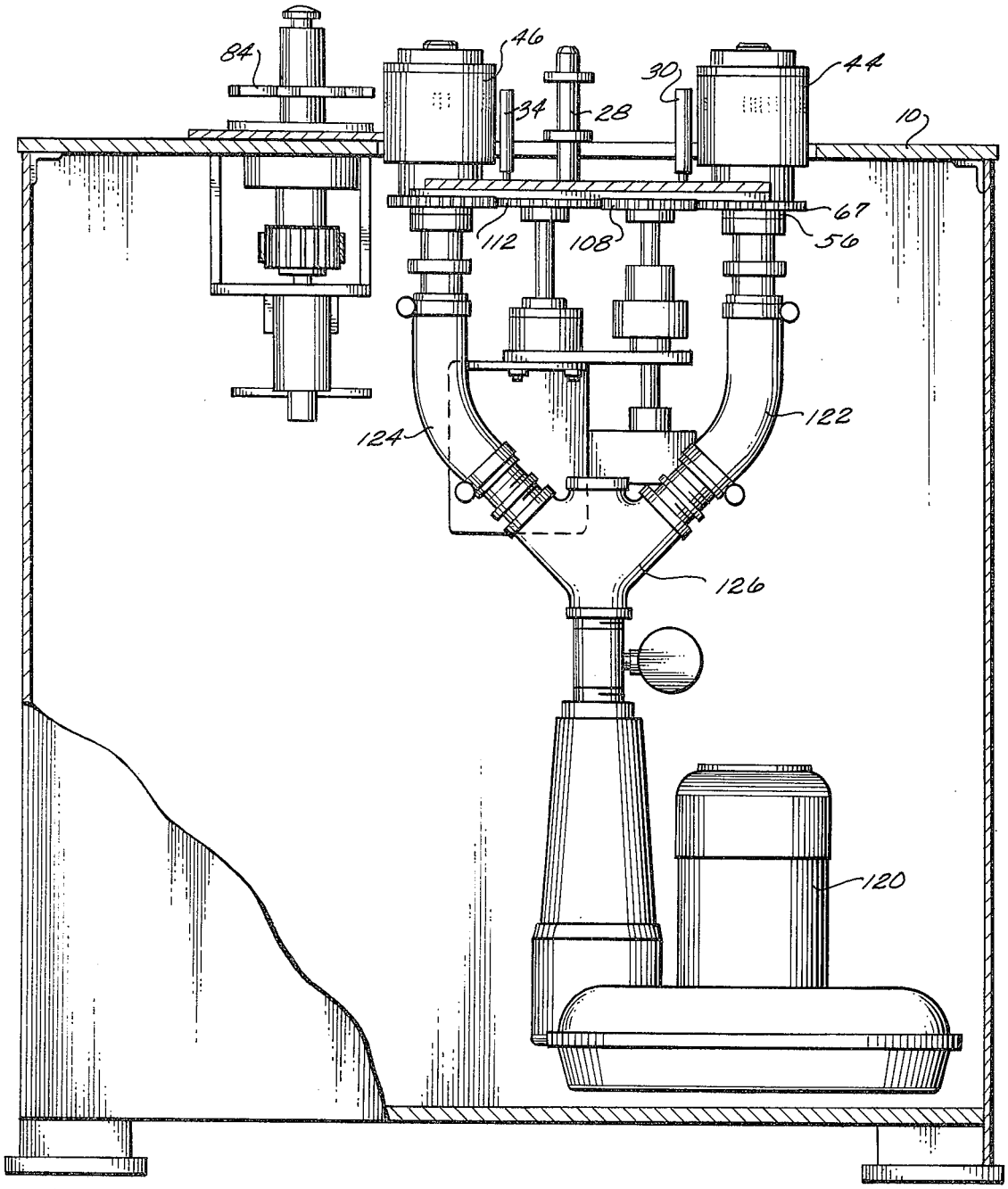
FIG. 6 is a sectional view taken substantially on the line 6—6 of FIG. 4.

Referring to FIG. 6, the vacuum system includes a centrifugal-type vacuum pump 120 which is coupled to the two vacuum drum assemblies through suitable hose connections 122 and 124 and a Y-connector 126.

The label transfer rollers 30 and 34 are rotatably mounted on the ends of mounting arms 128 and 130, respectively. These arms are adjustably supported from the frame so as to permit the transfer rollers to be spaced from the surface of the vacuum drums the proper distance to effect transfer of the labels from the carrier strip onto the surface of the drums. The product feed assembly 80, shown in more detail in FIGS. 4–7, includes a separate gearhead drive motor 132 which is connected to a belt drive 134 to a rotating pulley 136. The endless conveyor belt 88 passes around the pulley 136 and is driven thereby. Also driven from the motor 132 is the rotating conveyor member 84 by means of a belt drive 138 and gears 140 and 142.

From the above description, it will be seen that a high speed label applicator has been provided which transfers labels from both sides of the carrier strip to products in two separate product streams. The vacuum transfer mechanism provides a highly effective means of transferring the labels from the carrier strip to the respective product streams at high speed without subjecting the labels or carrier strip to undue bending forces which might result in breaking of the carrier strip or mutilation of the labels.

What is claimed is:

1. Apparatus for applying labels from a carrier strip having adhesive labels on both sides of the strip, comprising:

means feeding the carrier strip successively through first and second loops, the second loop being reversed from the first loop, first and second movable transfer means operatively associated respectively with the first and second loops, each transfer means having a surface moving tangential to the labels as they move through a respective one of the loops, means securing each label to the surface of the associated transfer means as it moves through the convex side of the loop, the transfer means pulling each label from the convex side of the carrier strip as it moves through the associated loop.

2. Apparatus of claim 1 wherein the radius of the first loop is sufficiently large to prevent separation of the labels from the inner side of the carrier strip.

3. Apparatus of claim 1 wherein the first movable transfer means includes a cylindrical member, means for rotating said cylindrical member, said member having radial passages opening in the outer cylindrical surface, means applying a vacuum to the inside of the cylindrical member to draw air into said passages, the convex side of the loop being substantially in tangential contact with the cylindrical member, the outside surface of a label coming in contact with the cylindrical member as it passes through the adjacent loop and being held against the cylindrical member by the vacuum, rotation of the cylinder peeling the label from the carrier strip.

4. Apparatus of claim 3 wherein the radius of the first loop is sufficiently large to prevent separation of the labels from the inner side of the carrier strip.

5. Apparatus for transferring labels from both sides of a carrier strip to individual units, comprising:

a frame, first and second cylindrical members rotatably supported on the frame, means for rotating said cylindrical members, said members having radial passages opening in the outer cylindrical surface, means applying a vacuum to the inside of the cylindrical members to draw air into said passages, and means moving and guiding the carrier strip successively through first and second loops, one side of the carrier strip being on the inside of one loop and on the outside of the other loop, bight portions of the respective loops being substantially in tangential contact with the respective cylindrical members, the outside surface of a label coming in contact with a cylindrical member as it passes through an adjacent loop being held against the cylinder member by the vacuum, rotation of the cylinder peeling the label from the carrier strip.

6. Apparatus of claim 5 wherein said vacuum means applies a vacuum to the inside of the cylindrical members through a predetermined sector of the circumference, whereby air is drawn through holes around a sector of the outside surface of the cylindrical member.

7. Apparatus of claim 6 wherein the sectors remain stationary as the cylindrical members rotate.

8. Apparatus of claim 7 wherein the loops are positioned adjacent one end of the respective sectors.

9. Apparatus of claim 8 further comprising means moving the units to be labeled tangentially to the respective cylinder members adjacent the other end of said sectors, a label being moved into contact with a unit at the tangent point.

* * * * *